US005919052A

United States Patent [19]

Ho

[11] Patent Number: 5,919,052

[45] Date of Patent: Jul. 6, 1999

[54] EARPHONE JACK

[76] Inventor: Ching-Chih Ho, 1025, Yung An Rd., Taoyuan, Taiwan

[21] Appl. No.: 09/004,446

[22] Filed: Jan. 8, 1998

[51] Int. Cl.[6] ..... H01R 9/09

[52] U.S. Cl. ..... 439/83; 439/668

[58] Field of Search ..... 439/83, 79, 63, 439/581, 669, 668; 200/51.1

[56] References Cited

U.S. PATENT DOCUMENTS 4,393,283 7/1983 Masuda ..... 200/51.1
4,795,352 1/1989 Capp et al. ..... 439/581
4,937,404 6/1990 Kitagawa ..... 200/51.1
5,466,160 11/1995 Ogura ..... 439/63
5,711,676 1/1998 Michael, III ..... 439/63

*Primary Examiner*—Neil Abrams
*Assistant Examiner*—T C Patel
*Attorney, Agent, or Firm*—Rosenberg, Klein & Bilker

[57] ABSTRACT

An earphone jack which includes a plurality of terminals mounted in a casing, and a cover plate covered on the casing to hold down the terminals, each terminal having a contact portion for contact with a contact on the earphone jack inserted into the earphone jack and a horizontal mounting portion extended out of a respective side notch on the casing and disposed in flush with the cover plate for fastening to a circuit board by a surface mounting technique.

4 Claims, 10 Drawing Sheets

EARPHONE JACK

BACKGROUND OF THE INVENTION

The present invention relates to earphone jacks, and more specifically to the mounting arrangement of terminals for an earphone jack.

FIG. 1 shows an earphone jack according to the prior art. This structure of earphone jack comprises a casing (1') having a tubular front neck (10') and a plug hole (12') defined with the tubular front neck (10'), cover plate (2') covered on the casing (1') at one side, and a plurality of terminals (3') having a downward mounting leg (31') extended out of a respective bottom hole (not shown) on the casing (1'). This earphone jack is not a SMT (surface mounting technique) design. Before mounting the earphone jack on a circuit board, mounting holes must be provided at the circuit board. In order to provide mounting hole for mounting the terminals of the earphone jack, the circuit board must have a certain thickness. Therefore, this structure of earphone jack is not practical for use in a mobile telephone, personal CD player, miniature tape recorder, or other small audio/video apparatus.

SUMMARY OF THE INVENTION

The present invention has been accomplished to provide an earphone jack which eliminates the aforesaid problem. It is the main object of the present invention to provide an earphone jack which is suitable for surface mounting. According to one aspect of the present invention, the earphone jack comprises a plurality of terminals mounted in a casing, and a cover plate covered on the casing to hold down the terminals, each terminal having a contact portion at one end for contact with a contact on the earphone jack inserted into the earphone jack and a horizontal mounting portion at an opposite end extended out of a respective side notch on the casing and disposed in flush with the cover plate for fastening to a circuit board by a surface mounting technique. According to another aspect of the present invention, each terminal has a curved retaining portion connected between the respective horizontal mounting portion and the respective contact portion and respectively retained between the vertical side walls of the casing and the cover plate.

DETAILED DESCRIPTION OF THE PREFERRED EMBODIMENT

Figure 1:
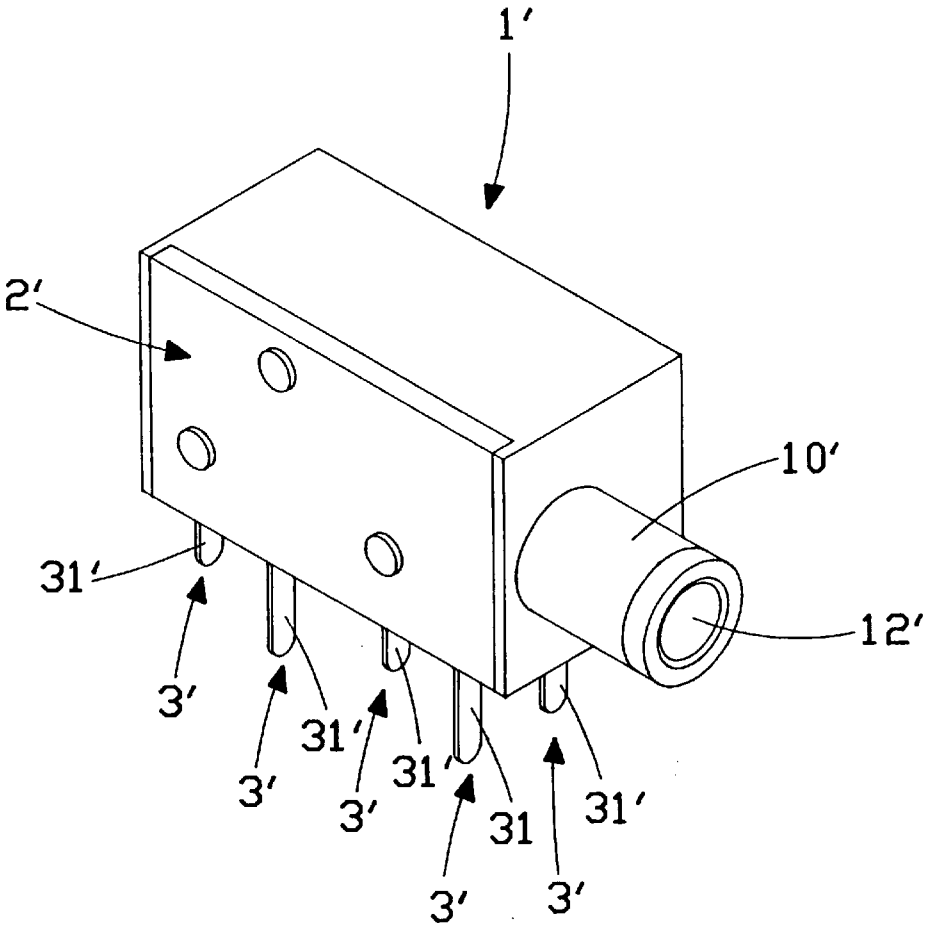
FIG. 1 PRIOR ART
FIG. 1 is an elevational view of an earphone jack according to the prior art.
Figure 2:
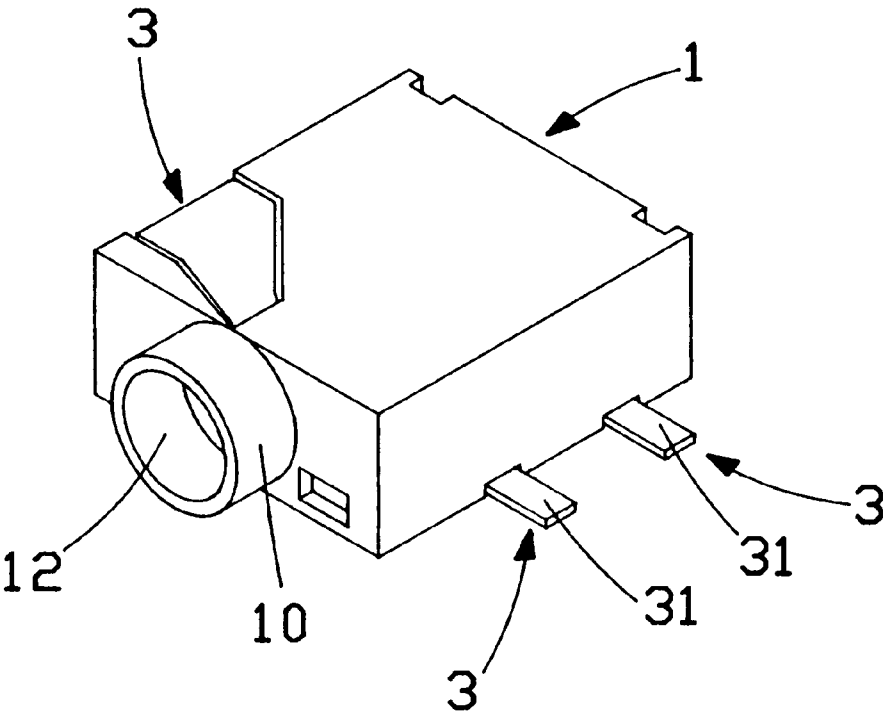
FIG. 2 is an oblique top side view of an earphone jack according to a first embodiment of the present invention.
Figure 4:
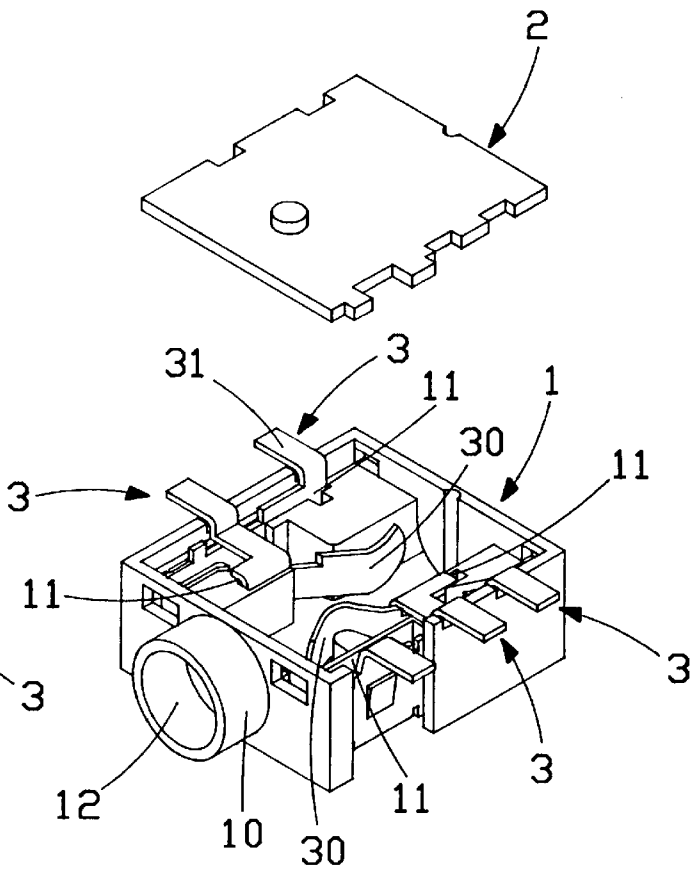
FIG. 4 is similar to FIG. 3 but showing the bottom cover plate removed from the casing.
Figure 3:
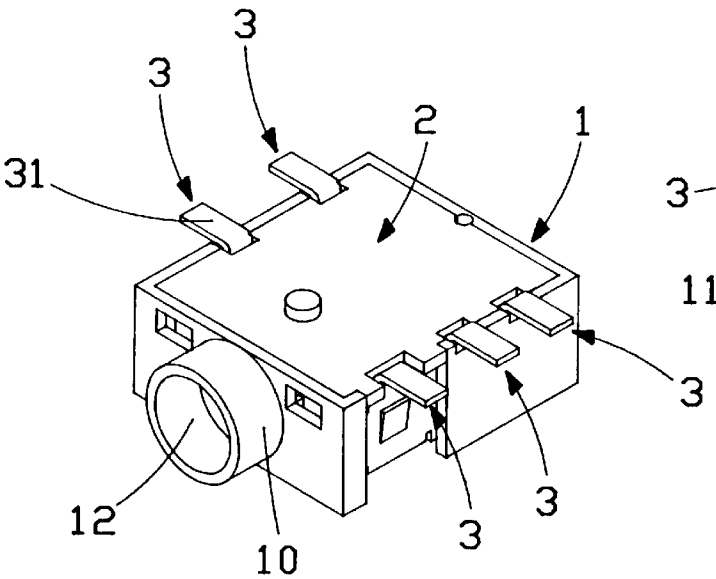
FIG. 3 is an oblique bottom side view of the earphone jack shown in FIG. 2.
Figure 5:
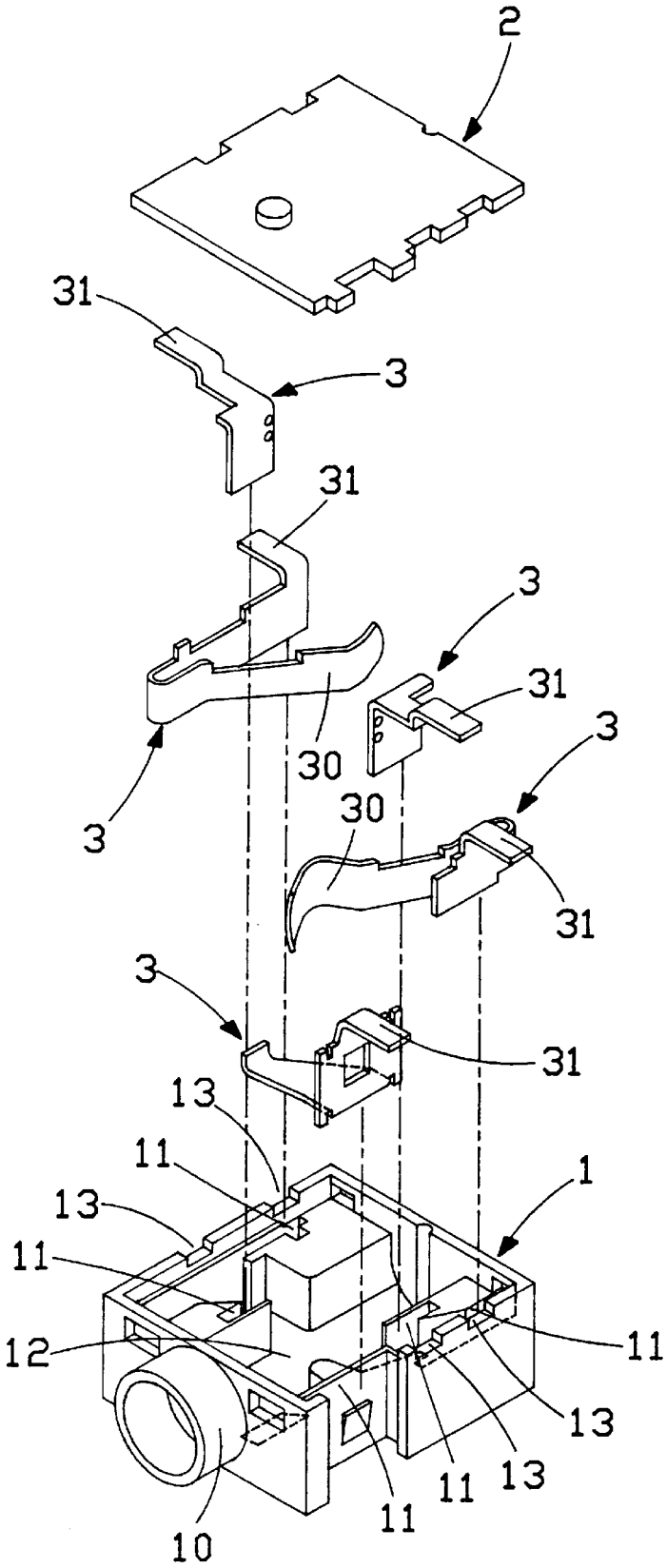
FIG. 5 is an exploded view of the earphone jack shown in FIG. 2.

Referring to Figures from 2 to 5, an earphone jack in accordance with the present invention is generally comprised of a casing 1, a cover plate 2, and a plurality of terminals 3. The casing 1 is a substantially rectangular, bottom-open container comprising a tubular front neck 10, a plug hole 12 defined within the tubular front neck 10 and extended to the inside of the casing 1, a plurality of mounting troughs 11 defined on the inside which receive the terminals 3 respectively, and a plurality of side notches 13 respectively disposed at two opposite lateral sides thereof. The terminals 3 are respectively mounted in the mounting troughs 11 inside the casing 1, having each a contact portion 30 at one end projecting into the plug hole 12 and a flat mounting portion 31 at an opposite end respectively extended out of the casing 1 through the side notches 13. The cover plate 2 is covered on the bottom open side of the casing 1 to hold down the terminals 3. When the earphone jack is assembled, the mounting portions 31 of the terminals 3 are maintained in horizontal in flush with the bottom cover plate 2 (see also FIG. 6).

Figure 6:
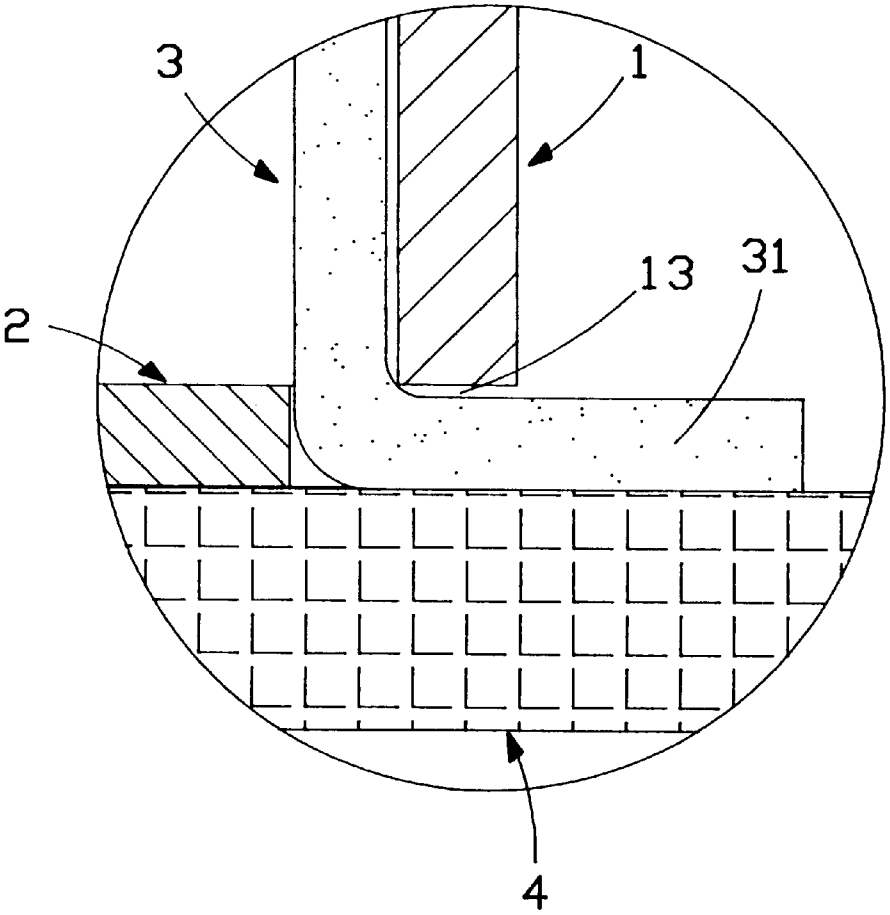
FIG. 6 is an enlarged view of a part of the first embodiment of the present invention, showing the mounting portion of the terminal fastened to the circuit board.
Figure 7:
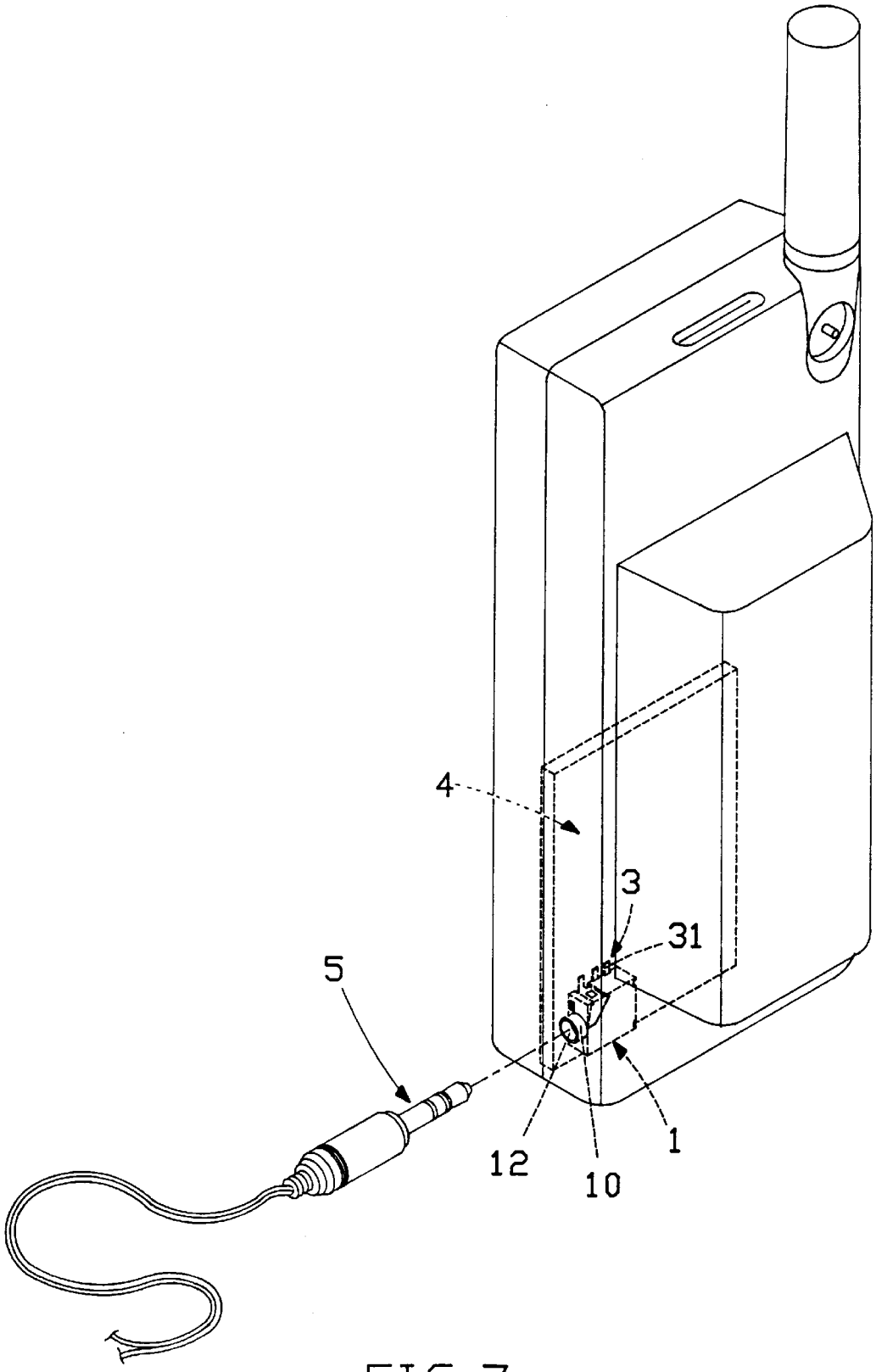
FIG. 7 is an applied view of the present invention, showing the earphone jack mounted on a circuit board inside a mobile telephone to receive an earphone plug.
Figure 8:
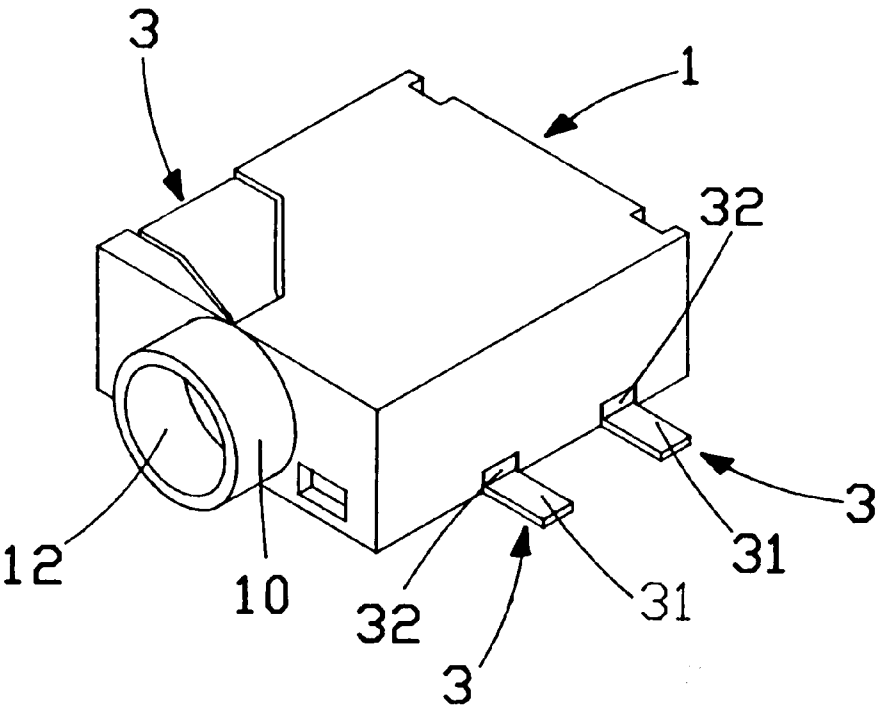
FIG. 8 is oblique top side view of an earphone jack according to a second embodiment of the present invention.
Figure 9:
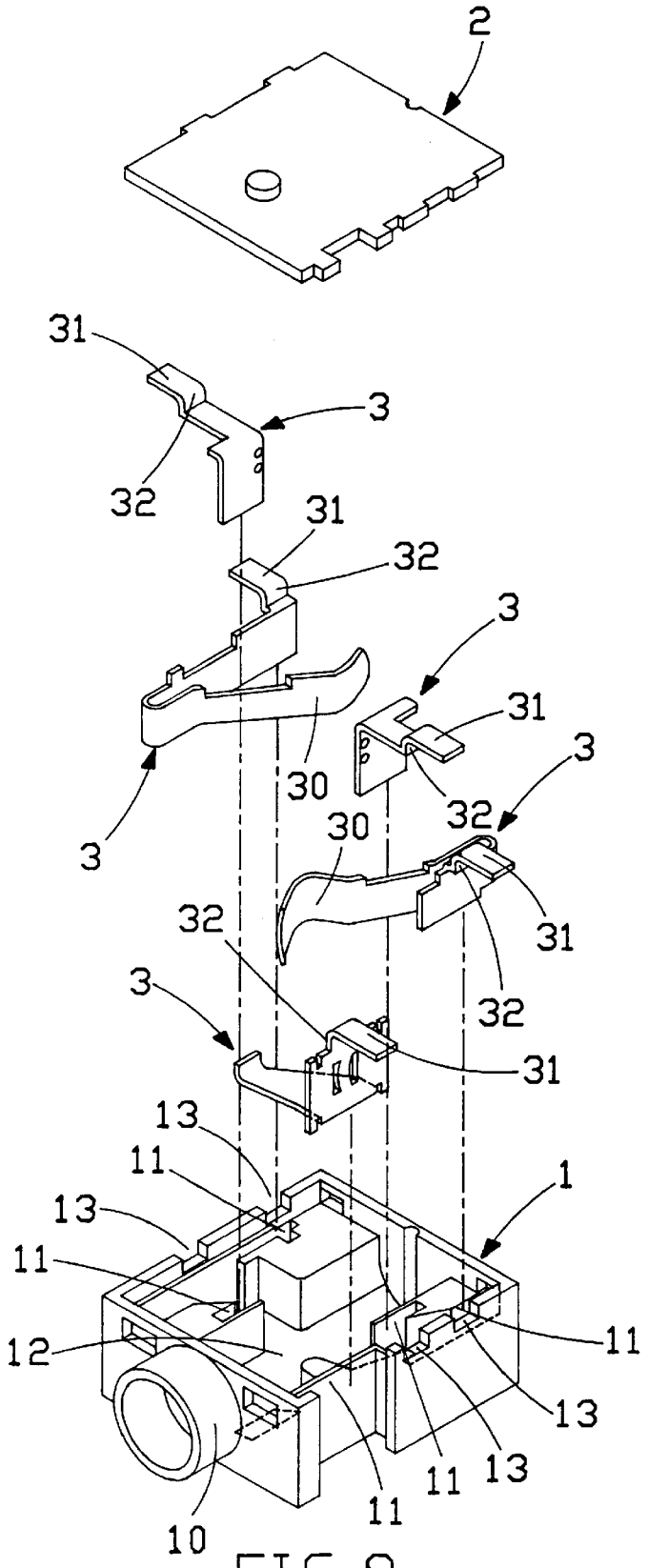
FIG. 9 is an exploded view of the earphone jack shown in FIG. 8.

Referring to FIGS. 6 and 7, the flat mounting portions 30 of terminals 3 are respectively soldered to a circuit board 4 for, for example, a mobile telephone. When an earphone plug 5 is inserted into the plug hole 12, the contacts of the earphone plug 5 are forced into contact with the contact portions 30 of the terminals 3 for signal transmission. Because the flat mounting portions 31 of terminals 3 are maintained in flush with the bottom cover plate 2,the terminals 3 can be conveniently fastened to the circuit board 4 by a surface mounting technique.

Figure 10:
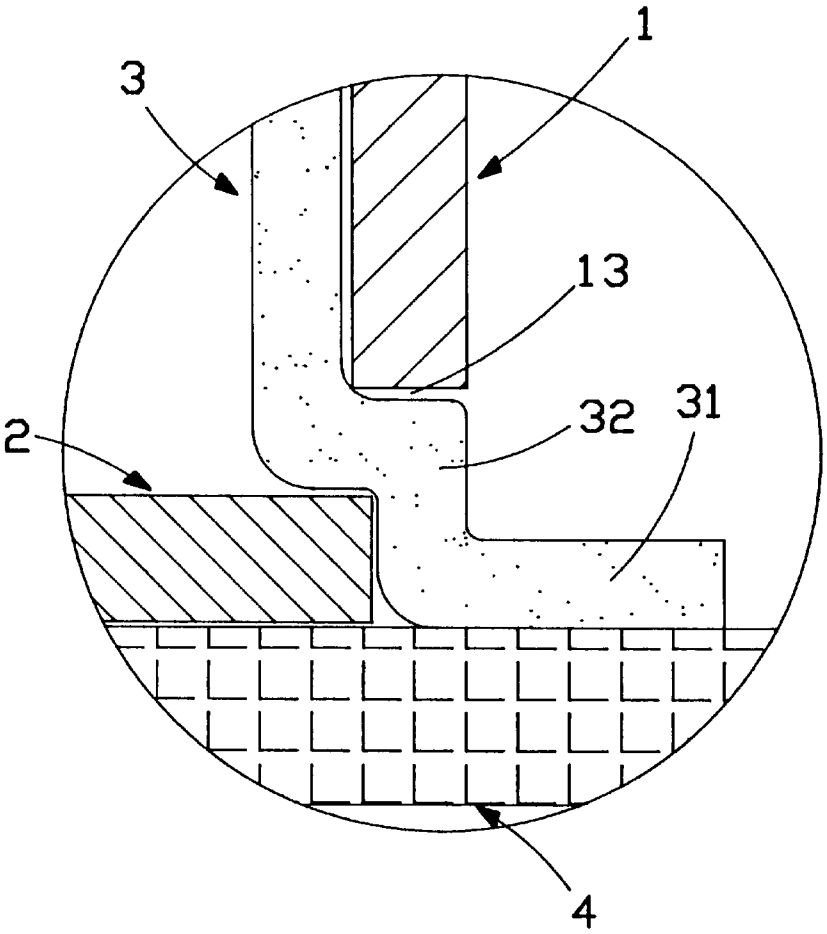
FIG. 10 is an enlarged view of a part of the earphone jack of the second embodiment of the present invention, showing the curved retaining portion of the terminal retained between the corresponding vertical side wall of the casing and the bottom cover plate.
Figure 11:
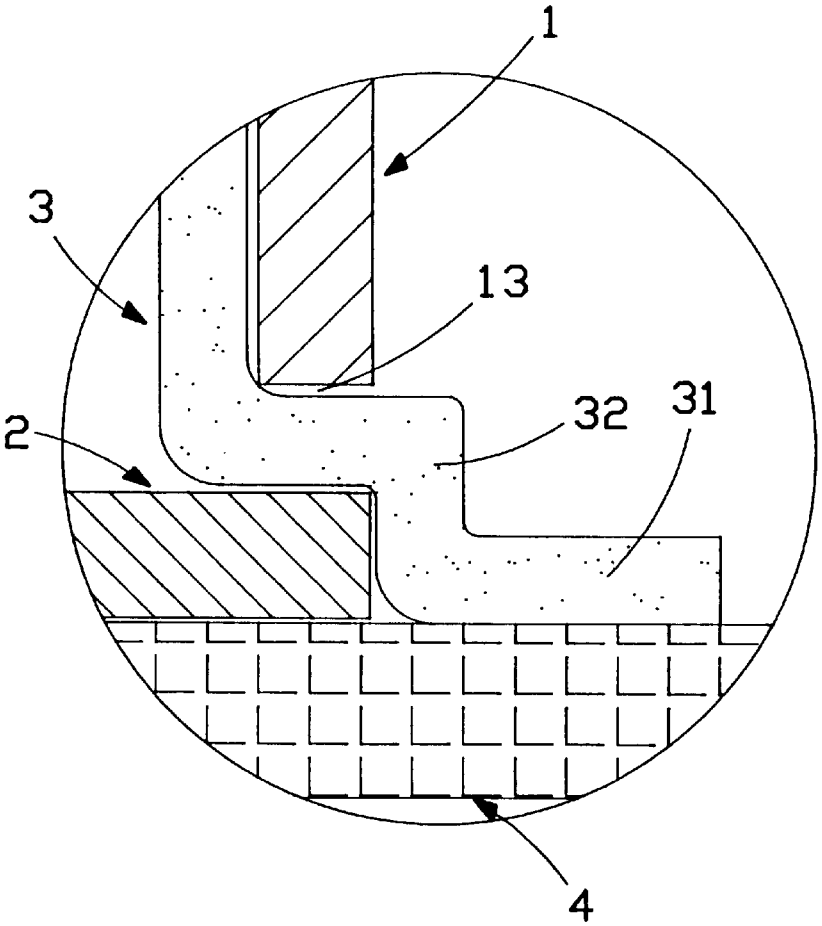
FIG. 11 is an enlarged view of a part of an earphone jack according to a third embodiment of the present invention, showing the curved retaining portion protruded over the corresponding side notch on the casing.

Figures from 8 to 10 show an alternate form of the present invention, in which each terminal 3 has a curved retaining portion 32 connected between the respective contact portion 30 and the respective flat mounting portion 31 and retained between the corresponding vertical side wall of the casing 1 and the bottom cover plate 2, and the flat mounting portion 31 of each terminal 3 is maintained in flush with the cover plate 2 and soldered to the circuit board 4. The curved retaining portion 32 has a vertical section disposed in flush with the outer surface of the corresponding vertical side wall of the casing 1 (see FIG. 10). Alternatively, the vertical section of the curved retaining portion 32 may protrude over the corresponding side notch 13 on the casing 1.

It is to be understood that the drawings are designed for purposes of illustration only, and are not intended as a definition of the limits and scope of the invention disclosed.

What the invention claimed is:

1. An earphone jack comprising a casing having a plug hole adapted to receive an earphone jack, a plurality of terminals mounted in said casing, said terminals having a respective inner end terminating in a contact portion retained in said plug hole for contact with a contact on the earphone jack inserted into said plug hole, and a cover plate fastened to a bottom open side of said casing to hold down said terminals, wherein said casing comprises a plurality of side notches respectively disposed at two opposite vertical side walls thereof; said terminals have a respective outer end terminating in a horizontal mounting portion respectively extended out of the side notches on said casing and disposed in flush with said cover plate for fastening to a circuit board by a surface mounting technique.

2. The earphone jack of claim 1, wherein said terminals have a respective curved retaining portion connected between the respective horizontal mounting portion and the respective contact portion and said cover plate.

3. The earphone jack of claim 2, wherein the curved retaining portion of each of said terminals has a vertical section disposed in flush with the corresponding vertical side wall of said casing.

4. The earphone jack of claim 2, wherein the curved retaining portion of each said terminals has a vertical section protruding over the corresponding side notch on said casing.

* * * * *